11/28/78 OR 4,127,139

United States Patent [19]

Sweeney

[11] 4,127,139

[45] Nov. 28, 1978

[54] LOW POUR GAS OILS

[75] Inventor: William M. Sweeney, Wappingers Falls, N.Y.

[73] Assignee: Texaco Inc., New York, N.Y.

[21] Appl. No.: 854,303

[22] Filed: Nov. 23, 1977

[51] Int. Cl.[2] ..... F17D 1/16; F17D 1/17

[52] U.S. Cl. ..... 137/13; 44/62; 44/70

[58] Field of Search ..... 44/62, 70; 526/331; 137/13

[56] References Cited

U.S. PATENT DOCUMENTS

| | | | |
|---|---|---|---|
| 3,776,247 | 12/1973 | Choufoer et al. | 137/13 |
| 3,830,761 | 8/1974 | Lenney | 526/331 |
| 3,904,579 | 9/1975 | Braddicks | 526/331 |
| 3,915,668 | 10/1975 | Basalay et al. | 44/62 |
| 4,050,742 | 9/1977 | Hughes et al. | 137/13 |

*Primary Examiner*—Winston A Douglas
*Assistant Examiner*—Y. Harris-Smith
*Attorney, Agent, or Firm*—Carl G. Ries; Thomas H. Whaley; Walter D. Hunter

[57] ABSTRACT

A low pour gas oil composition is prepared from a waxy crude by blending a 650°-750° F distillate fraction from a crude oil with a minor amount of a 350°-650° F fraction of a middle distillate and from 0.01 to about 0.5 weight percent of an oil-soluble vinyl acetate-ethylene-vinyl chloride or allyl chloride terpolymer, the said terpolymer having a number average molecular weight of about 4,000 to about 70,000.

10 Claims, No Drawings

LOW POUR GAS OILS

BACKGROUND OF THE INVENTION

1. Field of the Invention

This invention is concerned with means for providing a gas oil composition at a reduced cost. More particularly the invention is concerned with a gas oil composition containing a major amount of cheaper higher boiling constituents and a minor amount of more expensive middle distillate, this fuel being a low pour composition owing to the incorporation therein of a small amount of an oil-soluble vinyl acetate-ethylene-vinyl chloride or allyl chloride terpolymer.

2. Description of the Prior Art

As is well known, gas oils distillates boiling at 650°-750° F. contain quantities of wax which render them viscous and give unacceptably high pour points. These oils behave as non-Newtonian liquids at low tempertures: exhibit variable solidifying temperature and peculiar hysteresis phenomena — all of which render them difficult to use as fuel.

One approach used in converting these oils has been to subject them to fairly lengthy dewaxing procedures. This, however, is an expensive procedure.

Another approach which has been used to bring the viscosity of "crude" gas oils to suitable levels has been to dilute or "cut" them with a major amount of lighter distillate oils but this is an expensive procedure because of the considerably higher cost of the distillate oils relative to the higher boiling oils. Generally, the ratio of distillate to higher boiling gas oil used has been 9 to 1. The distillate can be sold directly as a diesel fuel and as such is valuable and in short supply.

A number of additives have been suggested and tried with success in lubricating oils and in so-called middle distillates in order to tie in the wax therein and improve fluid at low temperatures. Such additives consist either of compounds formed by alkylating benzene or naphthalene derivatives or of copolymers of ethylene-vinyl fatty acid ester of a molecular weight up to 3,000 and containing from 15 to 25% by weight of the vinyl fatty acid ester. These additives are not however, effective in depressing the pour point of crude turbine fuel oils.

It is therefore the main object of the present invention to provide a fuel composition based on crude oil which will be free of the above mentioned prior art limitations.

An equally important object of this invention is to provide a gas oil composition having improved pour point characteristics by incorporating therein a minor amount of distillate oil and a small amount of an oil-soluble vinyl acetate-ethylene-vinyl chloride terpolymer.

Other objects of this invention will in part be obvious and in part hereinafter pointed out.

BRIEF DESCRIPTION OF THE INVENTION

The turbine fuel oil of the invention comprises from about 55 to about 90 weight percent of a gas oil fraction boiling at about 650°-750° F., from about 10 to about 45 weight percent of middle distillate oils boiling from 350° to 650° and from about 0.01 to about 0.5 weight percent of an oilsoluble vinyl acetate-ethylene-vinyl chloride or allyl chlorde terpolymer.

DETAILED DESCRIPTION OF THE INVENTION

Any gas oils boiling at 650°-750° F. or middle distillate fractions boiling at 350°-650° F. may be employed in the gas oil compositions of this invention. For example, gas oil and middle distillate derived from Mata crude from Guatemala as described below may be employed.

There was charged to a still Mata crude oil from Guatemala which had the following characterization:

| | |
|---|---|
| % Wax St 265*-dissolve in MIB ketone-cool 0° F. filter and weight wax, etc. | 2.03 |
| Gravity ° API | 30.06 |
| % Sulfur, X-ray | 0.86 |
| Wt. % Ash | 0.002 |
| Kin. Viscosity, cs at 100° F | 7.52 |
| at 150 ° F | 3.79 |
| Carbon residue, wt % | 3.89 |
| Flash pt. PM, ° F | 58.4 |
| Basic Nitrogen, ppm | 3.93 |
| Total Nitrogen, ppm | 1573 |
| Pour Point, ° F | −15 |

*The percent of wax was determined by dissolving a sample of the oil in methyl isobutyl ketone, cooling the resulting solution to 0° F, filtering off the wax and weighing it.

The fraction boiling from 350°-650° F. (atmospheric) was obtained in 34% yield and had a pour point −5° F. The fraction boiling from 650°-750° F. was obtained in 11.3% yield and had a pour point of +100° F. Blends of the two oils in different proportions were prepared and their kinematic viscosities (cs at 100° F.) and their pour points were determined. The Table I below shows the values obtained.

TABLE I

| Wt. % of 350-650° F cut | Wt. % of 650-750° F cut | Kin. Vis. | Pour Point(° F) |
|---|---|---|---|
| 0 | 100 | 13.69 | +65 |
| 10 | 90 | 10.63 | +55 |
| 25 | 75 | 7.83 | +55 |
| 40 | 60 | 5.45 | +50 |
| 100 | 0 | 2.43 | −5 |

The oil-soluble terpolymers useful in preparing the crude oil compositions of this invention comprise recurring units of:

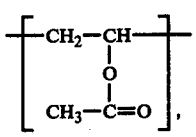

(a)

$+CH_2-CH_2+$ and (b)

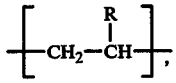

(c)

wherein R is selected from the group consisting of $-CH_2Cl$ and $-Cl$.

The number average molecular weight of the terpolymer utilized in this invention as previously described will range from about 4000 to about 70,000 or more and preferably will be from about 15,000 to about 30,000 as determined by vapor pressure osmometry.

In the vinyl acetate-ethylene-vinyl chloride terpolymer the weight percent of the units (i.e., vinyl acetate units) is about 15 to about 40; the weight percent of c units (i.e., vinyl chloride or allyl chloride units) is about 0.5 to about 5.0 with the b units (i.e., ethylene units) being the balance.

Preparation of the vinyl acetate-ethylene-vinyl chloride or allyl chloride terpolymer is conducted using processes well known in the art. For example, ethylene, vinyl acetate, vinly chloride and benzene are fed continuously into a stirred reactor at a temperatue of from about 70° to about 120° C. and under pressures ranging from about 1000 to 5000 psig. A variety of catalysts may be utilized however, a preferred catalyst is azobisisobutyronitrile which is added as a benzene solution at the rate of about 0.5 to 2.0 lbs/1000 lbs. of polymer. Residence time in the reactor is about 0.1 to about 1.0 hour or more. After the reaction mixture is removed from the reactor, the solvent and unreacted starting material is stripped off yielding the terpolymer product.

The amount of the terpolymer pour depressant incorporated into the gas oil compositions of this invention may be varied over a wide range. Generally the amount of the terpolymer in the gas oil composition will vary from about 0.01 to about 0.50 weight percent and preferably between about 0.02 to about 0.25 weight percent.

The required amount of vinyl acetate-ethylene-vinyl chloride or allyl chloride terpolymer may be added with mixing directly to the gas oil-middle distillate mixture which preferably is heated. Preferably, the terpolymer is added to the gas oil-middle distillate mixture in solution form dissolved in a hydrocarbon such as benzene, toluene, xylene, kerosene, etc., at a temperature of about 20 to about 120° C. with mixing. Generally, the concentration of the terpolymer in the hydrocarbon will range from about 0.5 to about 10 or more weight percent.

The following example illustrates one embodiment of this invention and is to be considered not limitative.

EXAMPLE I

Ethylene, vinyl acetate, vinyl chloride and benzene are fed continuously at rates of 10.01, 4.49, 0.01 and 2.70 lbs./hr. respectively into a 2 liter stirred reactor maintained at a temperature of 80°-110° C. at 4000 psig. Azobisisobutyronitrile is employed as the catalyst and is introduced into the reactor in a benzene solution at the rate of 0.8 lbs./1000 lb. of polymer. The residence time in the reactor is 15 minutes. After the reaction mixture is removed from the reactor it is stripped of solvent and unreacted materials yielding the terpolymer product. The composition of the terpolymer is about 28 weight percent vinyl acetate, 0.7 weight percent of vinyl chloride and 71.3 weight percent ethylene with a number average molecular weight of about 20,000.

A gas oil composition is prepared by adding with mixing at 60° C. for 1 hour a sufficient amount of the above prepared terpolymer to a mixture of 90 percent gas oil (650°-750° F.) and 10 percent middle distillate (350°-650° F.) crude so that the concentration of the additive was 0.10 weight percent. The pour point of this composition is determined by the method of ASTM D-97 and found to be substantially below the pour point of the same gas oil-middle distillate mixture without the terpolymer which has a pour point of 55° F.

In another aspect, this invention relates to an improved process for the transportation of the novel gas oil compositions described in detail above.

The improved process of this invention for the pipeline transportation of the gas oil composition described above comprises introducing into the said pipeline a gas oil composition comprising about 55 to about 90 weight percent of a gas oil boiling at about 650° to about 750° F.; from about 10 to about 45 weight percent of a middle distillate boiling at about 350° to about 650° F. and an effective pour depressant amount of a vinyl acetate-ethylene-vinyl chloride or allyl chloride terpolymer. Generally, the amount of the terpolymer will range from about 0.01 to about 0.50 weight percent.

What is claimed is:

1. A gas oil composition having improved pour point characteristics comprising from about 55 to about 90 weight percent of a gas oil boiling at about 650° to about 750° F., from about 10 to about 45 weight percent of a middle distillate boiling at about 350° to about 650° F. and an effective pour depressant amount of an oil-soluble terpolymer comprising recurring units of:

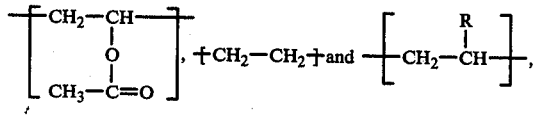

wherein R is selected from the group consisting of $-CH_2Cl$ and $-Cl$.

2. The composition of claim 1 wherein the said terpolymer comprises about 15 to about 40 weight percent vinyl acetate, from about 0.5 to about 5.0 weight percent vinyl chloride with the balance being ethylene.

3. The composition of claim 1 wherein the said terpolymer comprises about 28 percent by weight vinyl acetate, about 0.7 percent by weight of vinyl chloride with the balance being ethylene.

4. The composition of claim 1 wherein the number average molecular weight of the said terpolymer will range from about 4000 to about 70,000.

5. The composition of claim 1 wherein the number average molecular weight of the said terpolymer will range from about 15,000 to about 30,000.

6. A solution of an oil-soluble terpolymer comprising recurring units of:

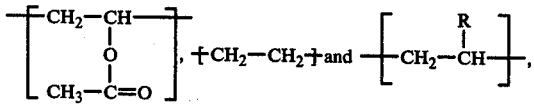

wherein R is selected from the group consisting of $-CH_2Cl$ and $-Cl$, in a hydrocarbon selected from the group consisting of benzene, toluene and xylene.

7. The solution of claim 6 wherein the concentration of the said terpolymer ranges from about 0.5 to about 10 weight percent.

8. In the transportation of a gas oil composition, the improvement which comprises introducing into a pipeline a gas oil composition comprising from about 55 to about 90 weight percent of a gas oil boiling at about 650° to about 740° F., from about 10 to about 45 weight percent of a middle distillate boiling at about 350° to about 650° F. and an effective pour depressant amount of an oil-soluble terpolymer comprising recurring units of:

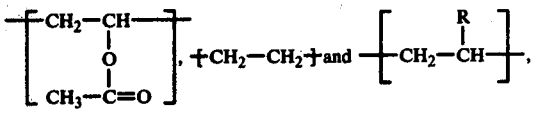

wherein R is selected from the group consisting of $-CH_2Cl$ and $-Cl$.

9. The process of claim 8 wherein the said terpolymer comprises about 15 to about 40 weight pecent vinyl acetate, from about 0.5 to 5.0 weight percent vinyl chloride with the balance being ethylene.

10. The process of claim 8 wherein the said terpolymer comprises about 28 percent by weight vinyl acetate, about 0.7 percent by weight of vinyl chloride with the balance being ethylene.

* * * * *